US008495881B2

(12) United States Patent
Edwards et al.

(10) Patent No.: US 8,495,881 B2
(45) Date of Patent: Jul. 30, 2013

(54) SYSTEM AND METHOD FOR THERMAL CONTROL IN A CAP OF A GAS TURBINE COMBUSTOR

(75) Inventors: Kara Johnston Edwards, Greer, SC (US); Kevin Weston McMahan, Greer, SC (US); Thomas Edward Johnson, Greer, SC (US); Jonathan Dwight Berry, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1091 days.

(21) Appl. No.: 12/476,926

(22) Filed: Jun. 2, 2009

(65) Prior Publication Data

US 2010/0300106 A1 Dec. 2, 2010

(51) Int. Cl.
*F02C 1/00* (2006.01)

(52) U.S. Cl.
USPC ..... 60/752; 60/804; 60/746; 60/747; 60/748; 60/754; 60/756

(58) Field of Classification Search
USPC ..... 60/804, 746, 747, 752, 754, 748, 60/737, 756
See application file for complete search history.

(56) References Cited

U.S. PATENT DOCUMENTS

| | | | | |
|---|---|---|---|---|
| 4,701,714 | A | 10/1987 | Agoston | |
| 5,216,886 | A | 6/1993 | Ewing | |
| 5,357,745 | A * | 10/1994 | Probert | 60/39.37 |
| 5,524,438 | A | 6/1996 | Johnson et al. | |
| 5,542,246 | A | 8/1996 | Johnson et al. | |
| 5,758,503 | A | 6/1998 | DuBell et al. | |
| 5,918,468 | A | 7/1999 | Cassells et al. | |
| 6,546,733 | B2 * | 4/2003 | North et al. | 60/772 |
| 6,675,586 | B2 | 1/2004 | Maghon | |
| 6,708,499 | B2 | 3/2004 | Pidcock et al. | |
| 6,857,275 | B2 | 2/2005 | Pidcock et al. | |
| 6,964,170 | B2 | 11/2005 | Alkabie | |
| 7,140,185 | B2 | 11/2006 | Burd | |
| 8,006,498 | B2 * | 8/2011 | Tschirren et al. | 60/756 |
| 2005/0022531 | A1 | 2/2005 | Burd | |

FOREIGN PATENT DOCUMENTS

WO WO2008017551 * 2/2008

* cited by examiner

*Primary Examiner* — William H Rodriguez
*Assistant Examiner* — Steven Sutherland
(74) *Attorney, Agent, or Firm* — Fletcher Yoder P.C.

(57) ABSTRACT

A system comprises a turbine combustor cap. The turbine combustor cap includes a plurality of segments. Each segment of the plurality of segments has edges abutting at least two fuel nozzle receptacles. Moreover, each segment of the plurality of segments does not completely surrounding any one fuel nozzle receptacle.

18 Claims, 9 Drawing Sheets

SYSTEM AND METHOD FOR THERMAL CONTROL IN A CAP OF A GAS TURBINE COMBUSTOR

BACKGROUND OF THE INVENTION

The subject matter disclosed herein relates to a system and method for thermal control in a cap of a gas turbine combustor.

A gas turbine engine includes a compressor, a combustor, and a turbine. The combustor receives compressed air from the compressor along with a fuel, and combusts a fuel-air mixture to generate hot gases of combustion. The hot gases flow through the turbine, thereby driving turbine blades. As appreciated, the combustor generates a significant amount of heat. Unfortunately, this heat can cause thermal expansion of various components, which in turn can lead to thermal cracks and other problems without suitable cooling or relief. For example, in a head end of the combustor, the heat may cause significant thermal expansion in a cap assembly.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine engine, comprising a combustor having a head end, a backing plate disposed in the head end, and a combustor cap coupled to the backing plate, wherein the backing plate and the combustor cap comprise a fuel nozzle receptacle, the combustor cap comprises a plurality of segments disposed about the fuel nozzle receptacle, and each segment comprises a plurality of air effusion ports.

In a second embodiment, a system includes a turbine combustor cap comprising a plurality of segments, wherein each segment of the plurality of segments has edges abutting at least two fuel nozzle receptacles without completely surrounding any one fuel nozzle receptacle.

In a third embodiment, a system includes a turbine combustor cap comprising a plurality of segments each comprising a front face, a rear face, and edges, wherein the edges of the plurality of fuel nozzles are disposed about a fuel nozzle receptacle, and each segment comprises a plurality of air effusion ports extending from the rear face, through the segment, and out of the front face.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
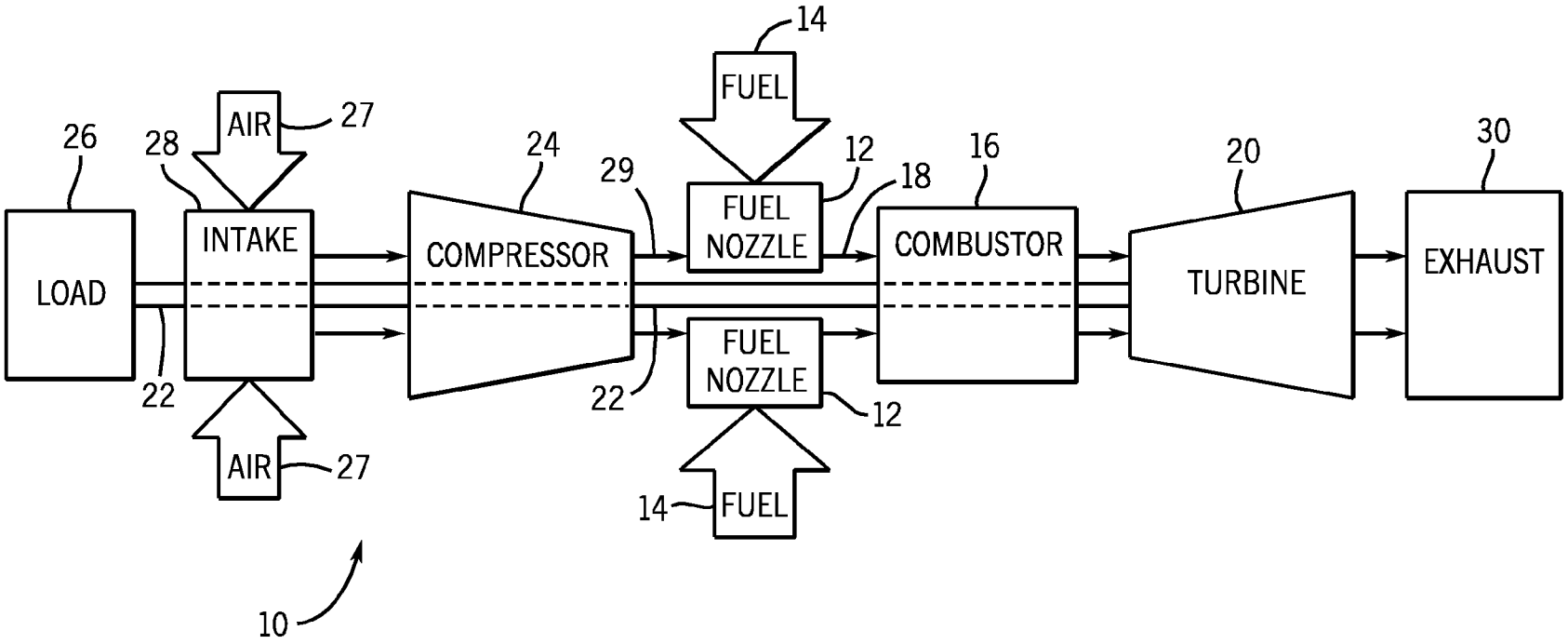
FIG. 1 is a block diagram of a turbine system having a fuel nozzle coupled to a combustor in accordance with an embodiment of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, embodiments of a turbine combustor cap may include a plurality of segments configured to reduce thermal stresses associated with heat generation in a gas turbine combustor. For example, the plurality of segments may include multiple segments per fuel nozzle. In some embodiments, each fuel nozzle is surrounded by 2, 3, 4, 5, or more segments, rather than one continuous structure around a circumference of the fuel nozzle. Together, the plurality of segments defines a plate-like geometry having one or more fuel nozzle receptacles. For example, each fuel nozzle receptacle may be defined by arcuate edges of two or more segments of the turbine combustor cap, thereby collectively defining a circular opening for the fuel nozzle.

In certain embodiments, the segments may create air gaps between one another to facilitate air cooling, while also permitting a degree of thermal expansion. Similarly, the segments may create air gaps adjacent to the fuel nozzles to facilitate cooling, while also permitting a degree of thermal expansion relative to the fuel nozzles. In addition, embodiments of the segments may include a mechanism to enable movement, e.g., in a radial and/or circumferential direction, for relief of the thermal expansion. Thus, the air gaps and the mechanism may substantially reduce the possibility of thermal stresses and cracking in the turbine combustor cap.

The disclosed embodiments also may include a backing plate coupled to the plurality of segments, wherein the backing plate directs air flow against the rear face of the segments. For example, the segments may be axially offset from the backing plate to define an intermediate cooling chamber. The backing plate may include air ports configured to direct air jets against the rear face of the segments to provide impingement cooling of the segments. In certain embodiments, the segments may be coupled to the backing plate via studs, wherein the studs are disposed through slots oriented in a radial direction. The engagement of the studs with slots may enable movement (e.g., radial and/or circumferential) of the segments relative to the backing plate, thereby providing relief to thermal expansion as mentioned above.

In certain embodiments, the segments may include openings (e.g., perforations) to facilitate effusion cooling. For example, the openings may pass axially through the segments from a rear face to a front face. The openings may be oriented in a variety of angles relative to the front face, e.g., 20 to 90 degrees. In certain embodiments, the openings may direct the air flow in a converging manner toward the fuel nozzles. However, any suitable configuration of openings is within the scope of the disclosed embodiments.

Turning now to the drawings and referring first to FIG. 1, a block diagram of an embodiment of a turbine system 10 is illustrated. The diagram includes fuel nozzles 12, a fuel supply 14, and combustor 16. As depicted, fuel supply 14 routes a liquid fuel or gas fuel, such as natural gas, to the turbine system 10 through a fuel nozzle 12 into the combustor 16. After mixing with pressurized air, shown by arrow 18, ignition occurs in the combustor 16 and the resultant exhaust gas causes blades within turbine 20 to rotate. The coupling between blades in turbine 20 and shaft 22 causes rotation of shaft 22, which is also coupled to several components throughout the turbine system 10, as illustrated. For example, the illustrated shaft 22 is drivingly coupled to a compressor 24 and a load 26. As appreciated, load 26 may be any suitable device that may generate power via the rotational output of turbine system 10, such as a power generation plant or a vehicle.

Air supply 27 may route air via conduits to air intake 28, which then routes the air into compressor 24. Compressor 24 includes a plurality of blades drivingly coupled to shaft 22, thereby compressing air from air intake 28 and routing it to fuel nozzles 12 and combustor 16, as indicated by arrows 29. Fuel nozzle 12 may then mix the pressurized air and fuel, shown by numeral 18, to produce an optimal mix ratio for combustion, e.g., a combustion that causes the fuel to more completely burn so as not to waste fuel or cause excess emissions. After passing through turbine 20, the exhaust gases exit the system at exhaust outlet 30. As discussed in detail below, an embodiment of the combustor 16 includes a combustor cap assembly that is segmented about each fuel nozzle 12, thereby providing relief for thermal expansion in the combustor 16.

Figure 2:
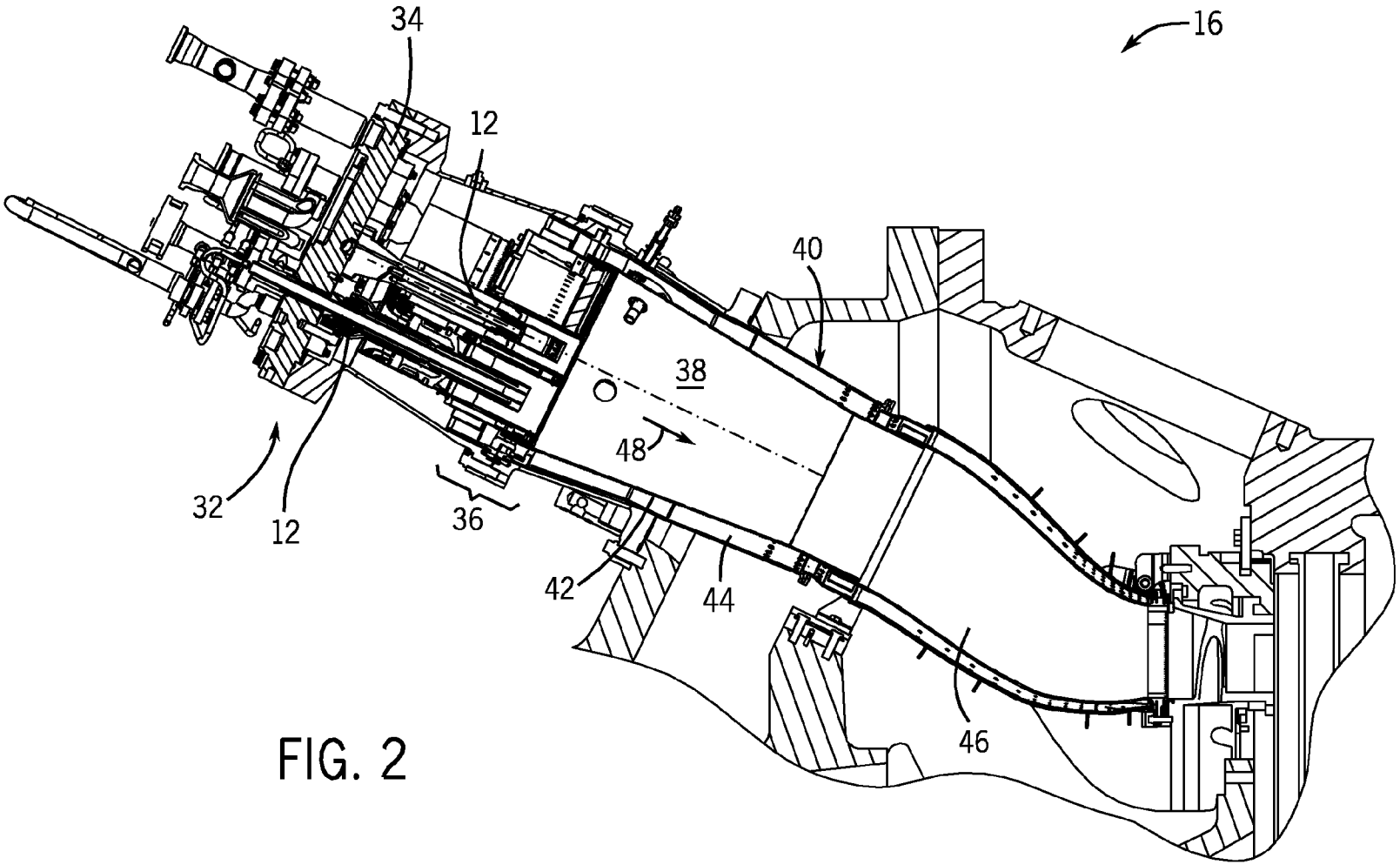
FIG. 2 is a cutaway side view of the combustor, as shown in FIG. 1, with a plurality of fuel nozzles coupled to an end cover in accordance with an embodiment of the present technique.

FIG. 2 shows a cutaway side view of an embodiment of combustor 16 having a plurality of fuel nozzles 12. In certain embodiments, a head end 32 of a combustor 16 includes an end cover 34. Additionally, head end 32 of the combustor 16 may include a combustor cap assembly 36, which closes off the combustion chamber 38 and houses the fuel nozzles 12. The fuel nozzles 12 route fuel, air, and other fluids to the combustor 16. In the diagram, a plurality of fuel nozzles 12 are attached to end cover 34, near the base of combustor 16, and pass through the combustor cap assembly 36. For example, the combustor cap assembly 36 receives one or more fuel nozzles 12 and creates a boundary from the combustion. Each fuel nozzle 12 facilitates mixture of pressurized air and fuel and directs the mixture through the combustor cap assembly 36 into a combustion chamber 38 of the combustor 16. The air fuel mixture may then combust in the combustion chamber 38, thereby creating hot pressurized exhaust gases. These pressurized exhaust gases drive the rotation of blades within turbine 20. Combustor 16 includes a flow sleeve 40 and a combustor liner 42 forming the combustion chamber 38. In certain embodiments, flow sleeve 40 and liner 42 are coaxial or concentric with one another to define a hollow annular space 44, which may enable passage of air for cooling and entry into the combustion zone 38 (e.g., via perforations in liner 42 and/or fuel nozzles 12). The design of the liner 42 provides optimal flow of the air fuel mixture to transition piece 46 (e.g., converging section) along directional line 48 towards turbine 20. For example, fuel nozzles 12 may distribute a pressurized air fuel mixture into combustion chamber 38, wherein combustion of the mixture occurs. The resultant exhaust gas flows through transition piece 46 along directional line 48 to turbine 20, causing blades of turbine 20 to rotate, along with the shaft 22.

During this process, the combustor cap assembly 36 may experience stress as combustion occurs. In particular, the pressurized air may be at a temperature, around 650-1300° F., which causes thermal expansion of combustor cap assembly 36. Fuel may be at around 50 to 350° F., thereby causing a thermal expansion of nozzle 12 that is of a lesser magnitude, relative to the thermal expansion of the combustor cap assembly 36. Nozzle 12 and combustor cap assembly 36 may be composed of similar or different materials, such as stainless steel, an alloy, or other suitable material. Furthermore, combustion may expose the combustor cap assembly 36 to temperatures ranging from approximately 2000° to 3000° or more Fahrenheit. As a result of exposure to these various temperatures, the combustor cap assembly 36 may experience considerable thermal stresses. As discussed in detail below, segmentation of the combustor cap assembly 36 may provide stress relief that may be caused, for example, by thermal expansion of the different components of the combustor cap assembly 36.

Figure 3:
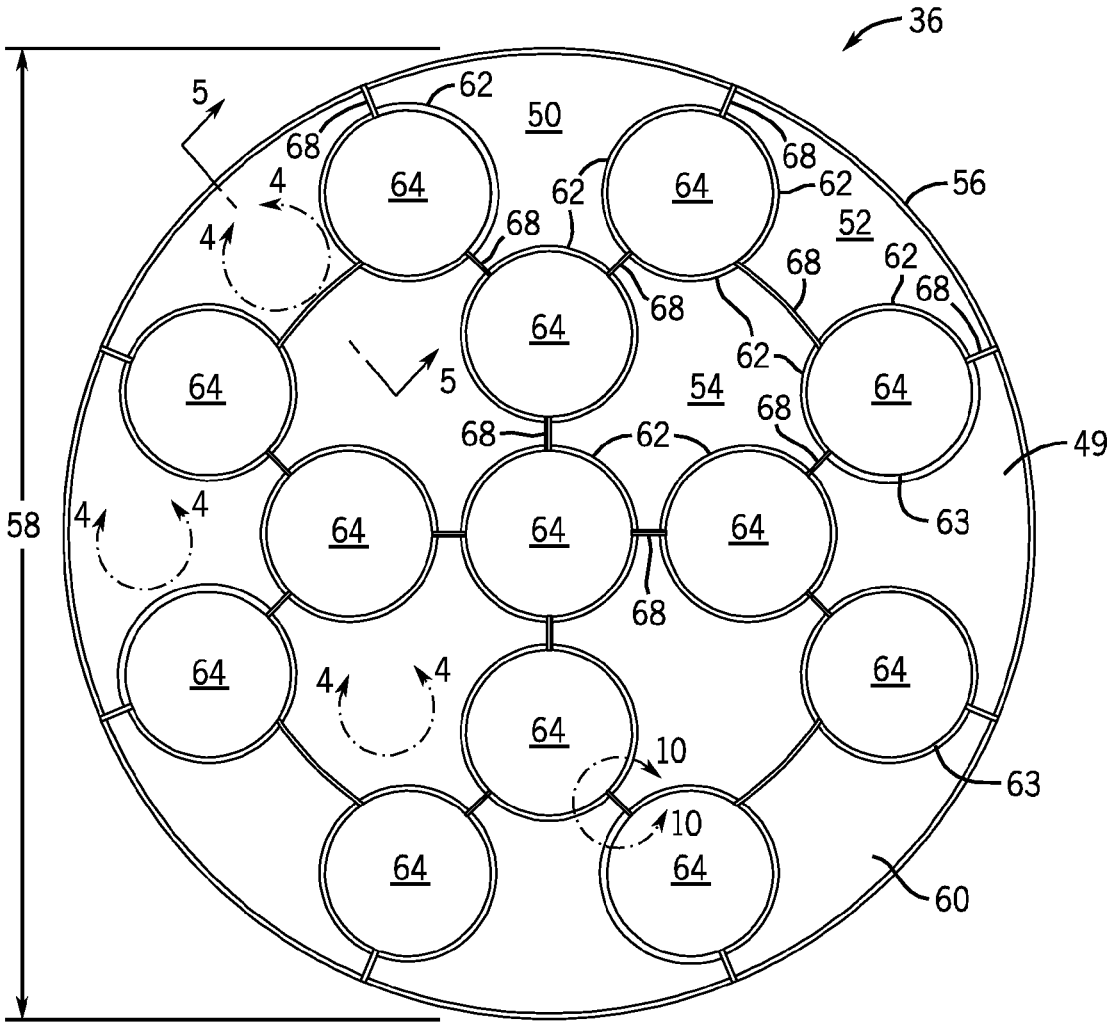
FIG. 3 is a front view of a combustor cap assembly in accordance with an embodiment of the present technique.

FIG. 3 illustrates a front view of an embodiment of the combustor cap assembly 36. The combustor cap assembly 36 may include a plurality of effusion plate segments 50, 52, and 54. The segments 50, 52, and 54 may be combined in a repeatable pattern to form a face 56 of the combustor cap assembly 36. The face 56 of the combustor cap assembly 36 may, for example, be circular in shape with a diameter 58 of approximately between 12 and 28 inches.

Each of the plurality of segments 50, 52, and 54 may include a front face 60, a rear face, and a plurality of edges 62. Each of the plurality of edges 62 of the plurality of segments 50, 52, and 54 may abut a nozzle burner tube 63 that surrounds a fuel nozzle receptacle 64. The nozzle burner tube 63 may, for example, create a metered fluid flow between a fuel nozzle receptacle 64 and a fuel nozzle 12 passing through the receptacle 64, for example, to block fluid leakage.

As illustrated, segment 50 may include three edges 62 that each abut a separate fuel nozzle receptacle 64, segment 52 may include two edges 62 that each abut a separate fuel nozzle receptacle 64, and segment 54 may include five edges 62 that each abut a separate fuel nozzle receptacle 64. In this manner, each segment 50, 52, and 54 includes edges 62 that abut at least two fuel nozzle receptacles 64 without completely surrounding any one fuel nozzle receptacle 64. In other words, each fuel nozzle 12 is surrounded by multiple segments rather than one continuous structure. Thus, the combustor cap 36 may include a first set of cap segments 50 and 52 disposed along an outer circumference of the turbine combustor cap, and a second set of cap segments 54 disposed around a central region of the turbine combustor cap, wherein the first set of cap segments completely encloses the second set of cap segments.

Furthermore, segments 50 and 52 may be disposed in a repeatable pattern along an outer circumference of the outer face 56 of the combustor cap assembly 36, whereby the segments 50 and 52 are placed in alternating circumferential positions adjacent one another. Additionally, segments 54 may be repeatably disposed about a central region offset in a radially inward direction from the outer face 56 of the combustor cap 36, adjacent the repeated segments 50 and 52 described above.

Figure 4:
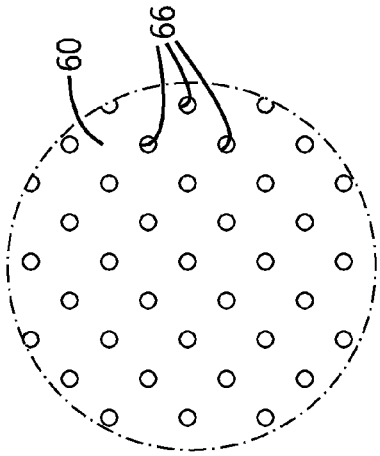
FIG. 4 is a detailed view of the combustor cap assembly of FIG. 3, as shown within line 4-4 of FIG. 3, in accordance with an embodiment of the present technique.

Each of the segments 50, 52, and 54 may allow for a fluid, such as air, to pass through the face of the segments 50, 52, and 54 via effusion ports 66 (FIG. 4). In this manner, the segments 50, 52, and 54 may combine to form an effusion plate 49, that is, a plate that allows for the flow of fluid through ports in the plate. FIG. 4 illustrates a partial top view of a face 60 of any of the segments 50, 52, or 54 through arcuate line 4-4.

As illustrated in FIG. 4, the front face 60 includes a plurality of effusion ports 66, e.g., approximately 100 to 5000 ports 66. Each of the segments 50, 52, and 54 may include approximately 10 to 500 effusion ports 66. For example, each of the segments 50, 52, and 54 may include at least approximately 50, 100, 150, 200, 250, 300, 350, or 400 effusion ports 66. In one embodiment, there may be approximately 1000 effusion ports 66 in total through the effusion plate 49 of the combustor assembly 36. Additionally, each effusion port 66 may have a diameter between approximately 4 to 100, 10 to 100, 20 to 40, 20 to 80, 20 to 35, or 50 to 60 thousands of an inch. For example, each effusion port 66 may be at least less than about 20, 30, 40, 50, 60, 70, 80, 90, or 100 thousands of an inch in diameter. In one embodiment, each segment 50, 52, and 54 may include least about 100 air effusion ports, where each effusion port is at least less than about 100 thousands of an inch in diameter.

As described above, the effusion ports 66 may allow fluid to pass through the segments 50, 52, and 54 to aid in cooling the segments 50, 52, and 54. Thus, the air effusion ports 66 may extend from the rear face axially through the respective segments 50, 52, or 54, and out of the effusion plate 49 of the combustor assembly 36. Furthermore, the effusion ports 66 may be angled relative to the front face 60 of each of the segments 50, 52, and 54. For example, the effusion ports 66 may pass fluid out of the effusion ports 66 at an angle of approximately 90, 80, 70, 60, 50, 40, 30, and/or 20 degrees relative to the front face 60 of each of the segments 50, 52, and 54. In another embodiment, the effusion ports 66 may be positioned at an angle of approximately less than about 45 degrees relative to the front face 60 of each of the segments 50, 52, and 54. Alternatively, each air effusion port 66 may be positioned at an angle of between approximately 20 to 70 degrees relative to the front face 60 of each of the segments 50, 52, and 54. Furthermore, the effusion ports 66 may be parallel or non-parallel, converging, or diverging. In one embodiment, the effusion ports 66 may converge towards the fuel nozzles 12. The effusion ports 66 may also be dispersed in a random pattern or in an organized pattern Returning to FIG. 3, the segments 50, 52, and 54 may each include edges 62 that abut separate fuel nozzle receptacles 64. Additionally, the segments 50, 52, and 54 may also include a plurality of ligament connections 68. These ligament connections 68 may be the regions of the segments 50, 52, and 54 that abut one another. For example, segment 50 may include four ligament connections 68 (one ligament connection 68 to each of two segments 52 and one ligament connection 68 to each of two segments 54), while segment 52 may include three ligament connections 68 (one ligament connection 68 to each of two segments 52 and a ligament connection 68 to a single segment 54). Similarly, segment 54 may include five ligament connections 68 (one ligament connection 68 to each of two segments 50, a ligament connection 68 to a single segment 52, and one ligament connection 68 to each of two segments 54). A ligament connection 68 between any two segments 50, 52 of the plurality of segments is configured to allow for thermal expansion of each of the two segments 50, 52 without contacting one another.

Figure 5:
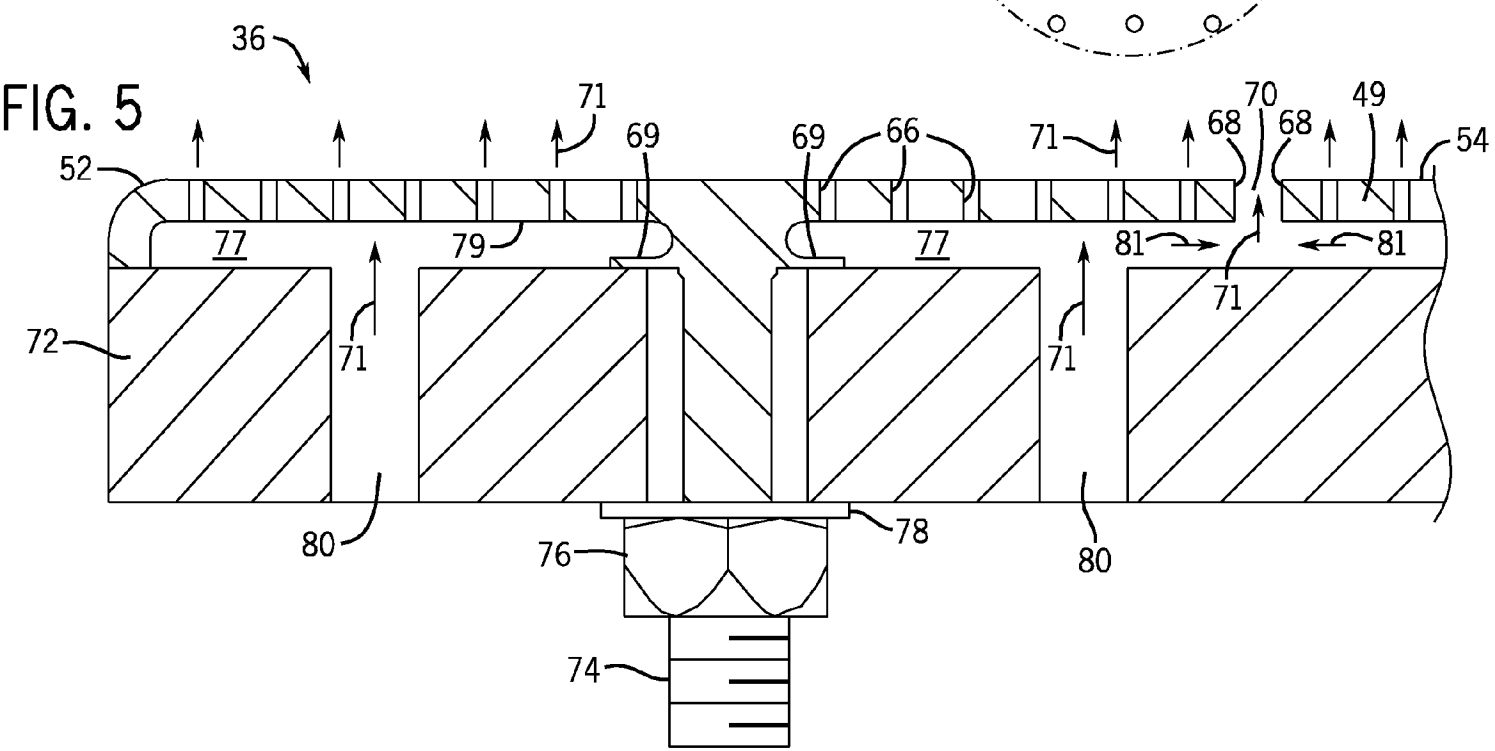
FIG. 5 is a cross-section along line 5-5 of FIG. 3 in accordance with an embodiment of the present technique.

The ligament connections 68 may each include an air gap 70. Thus, the segments 50, 52, and 54 may each be separated by an air gap 70. This air gap may be seen more clearly with respect to FIG. 5, which illustrates a cross-section of the combustor assembly 36 along line 5-5 of FIG. 3. The air gap 70 may be, for example, approximately 0.03 to 0.3 inches in width. As illustrated, the air gap 70 may also allow for air flow between the segments 52 and 54 along an axial path illustrated by axial arrow 71. Referring generally to FIGS. 3 and 5, the effusion plate 49 is coupled to a backing plate 72 via a plurality of fasteners, e.g., threaded studs or bolts 74 and nuts 76. In the illustrated embodiment, the each stud 74 may include a spacer, e.g., one or more washers 78, axially between the stud 74 and the backing plate 72. In particular, the effusion plate 49 (e.g., segments 50, 52, and 54) is axially offset from the backing plate 72 via a spacer 69 to define an intermediate cooling chamber 77 to facilitate impingement cooling of the rear face 79 of the effusion plate 49. Thus, the intermediate cooling chamber 77 may be between the backing plate 72 and the plurality of segments 50, 52, and 54, such that the backing plate 72 comprises an impingement passage directed toward a rear (interior) face 79 of each segment of the plurality of segments 50, 52, and 54.

The backing plate 72 also includes one or more air passages, or impingement cooling ports 80, configured to direct air jets into the intermediate cooling chamber 77, and directly against the rear face 79 of the segments 50, 52, and 54 of the effusion plate 49. In this manner, the backing plate 72 cooperates with the effusion plate 49 to provide impingement cooling of the individual segments 50, 52, and 54. In turn the air flow may pass through the segments 50, 52, and 54 via the effusion ports 66 in an axial direction 71, as well as between adjacent segments 50, 52, and 54 via air gaps 70. The air flow also may pass between the segments 50, 52, and 54 and the fuel nozzles 12. Collectively, the effusion cooling via ports 66, the intermediate cooling via air gaps 70, and the impingement cooling via ports 80 substantially cool the combustor cap assembly 36, while the segmentation (e.g., segments 50, 52, and 54) reduces thermal stresses by permitting some degree of unrestricted thermal expansion.

The air gap 70 and the ligament connections 68 may allow for thermal expansion of any given segment 50, 52, or 54. That is, certain nozzles 12 may heat at a greater rate than other nozzles 12 in the combustor 16, causing any edge 62 of segments 50, 52, and 54 adjacent to the fuel nozzle receptacle 64 of the hotter nozzle 12 to thermally expand in a radial direction, illustrated by arrows 81, at a greater rate than the remaining segments 50, 52, and 54. By providing an air gap 70 between the segments 50, 52, and 54, any segments 50, 52, and 54 exposed to this higher intensity heat may thermally expand without impacting upon any adjacent segments 50, 52, and 54. This may lead to reduced forces being placed on the combustor cap assembly 36 as a whole because the segments 50, 52, and 54 may thermally expand radially 81 without contacting one another, which might otherwise lead to, for example, cracking of the segments through the stress of contact between the segments 50, 52, and 54. For example, the air gap when exposed to thermal stress conditions may shrink by approximately 40, 50, 60, 70, 80, or 90 percent.

Figure 6:
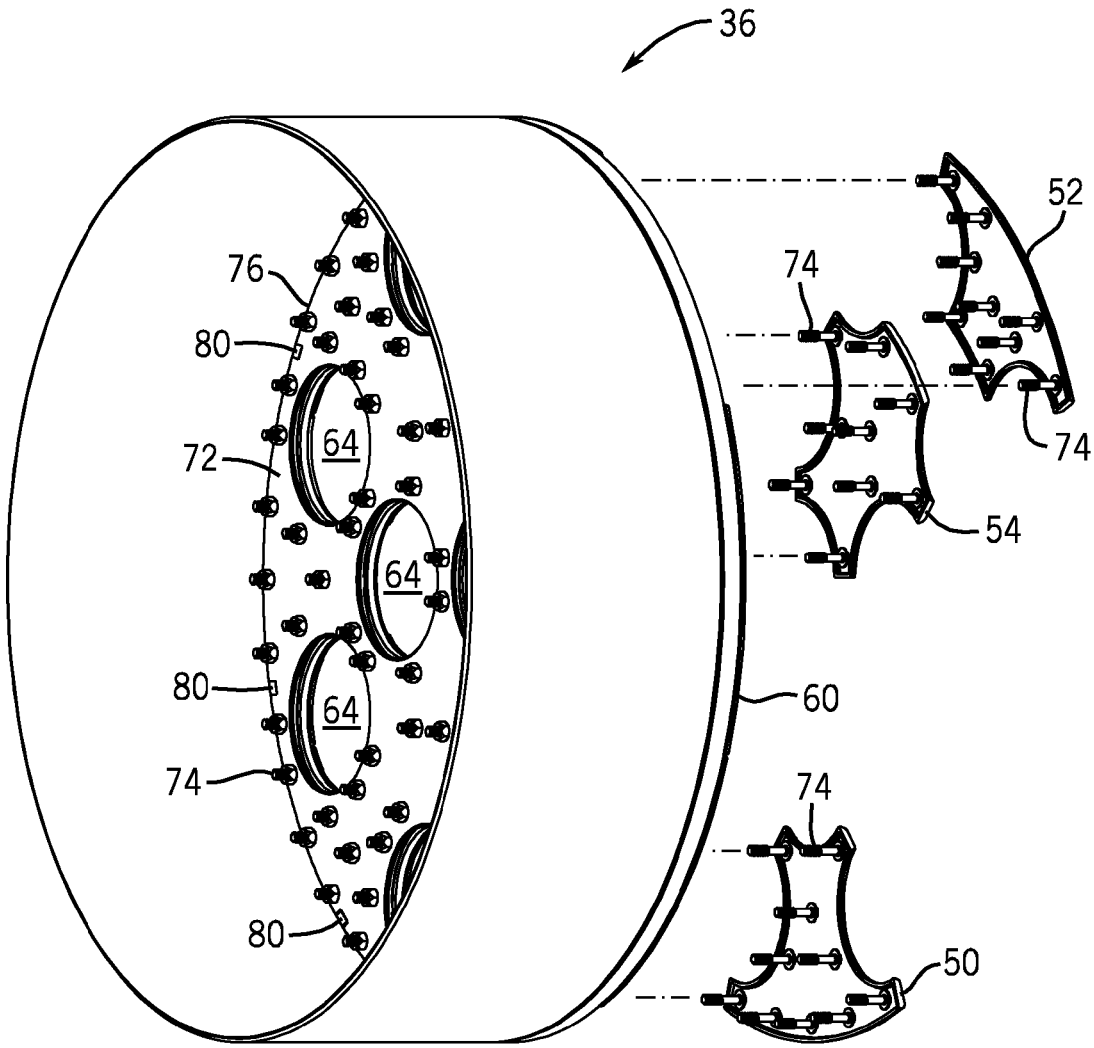
FIG. 6 is an exploded rear perspective view of the combustor cap assembly as shown in FIG. 3, in accordance with an embodiment of the present technique.
Figure 7:
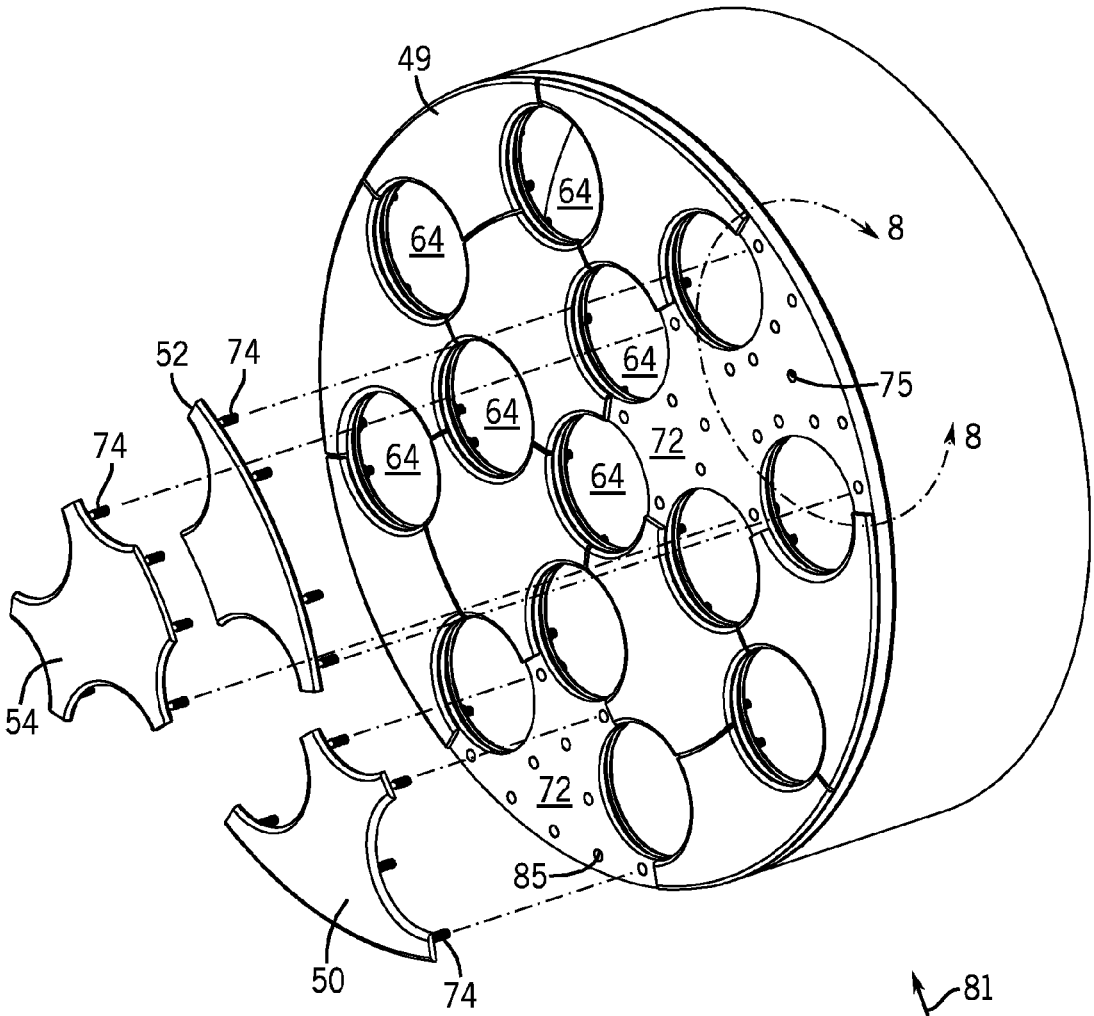
FIG. 7 is an exploded front perspective view of the combustor cap assembly as shown in FIG. 3, in accordance with an embodiment of the present technique.
Figure 7:
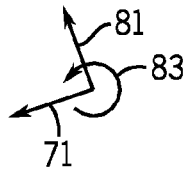

FIG. 6 is an exploded rear perspective view of an embodiment of the combustor cap assembly 36 while FIG. 7 is exploded front perspective of an embodiment of the combustor cap assembly 36. Referring generally to FIGS. 6 and 7, the effusion plate 49 is coupled to a backing plate 72 via a plurality of studs 74 and nuts 76. As described above, the backing plate 72 cooperates with the effusion plate 49 to provide impingement cooling of the individual segments 50, 52, and 54.

Figure 8:
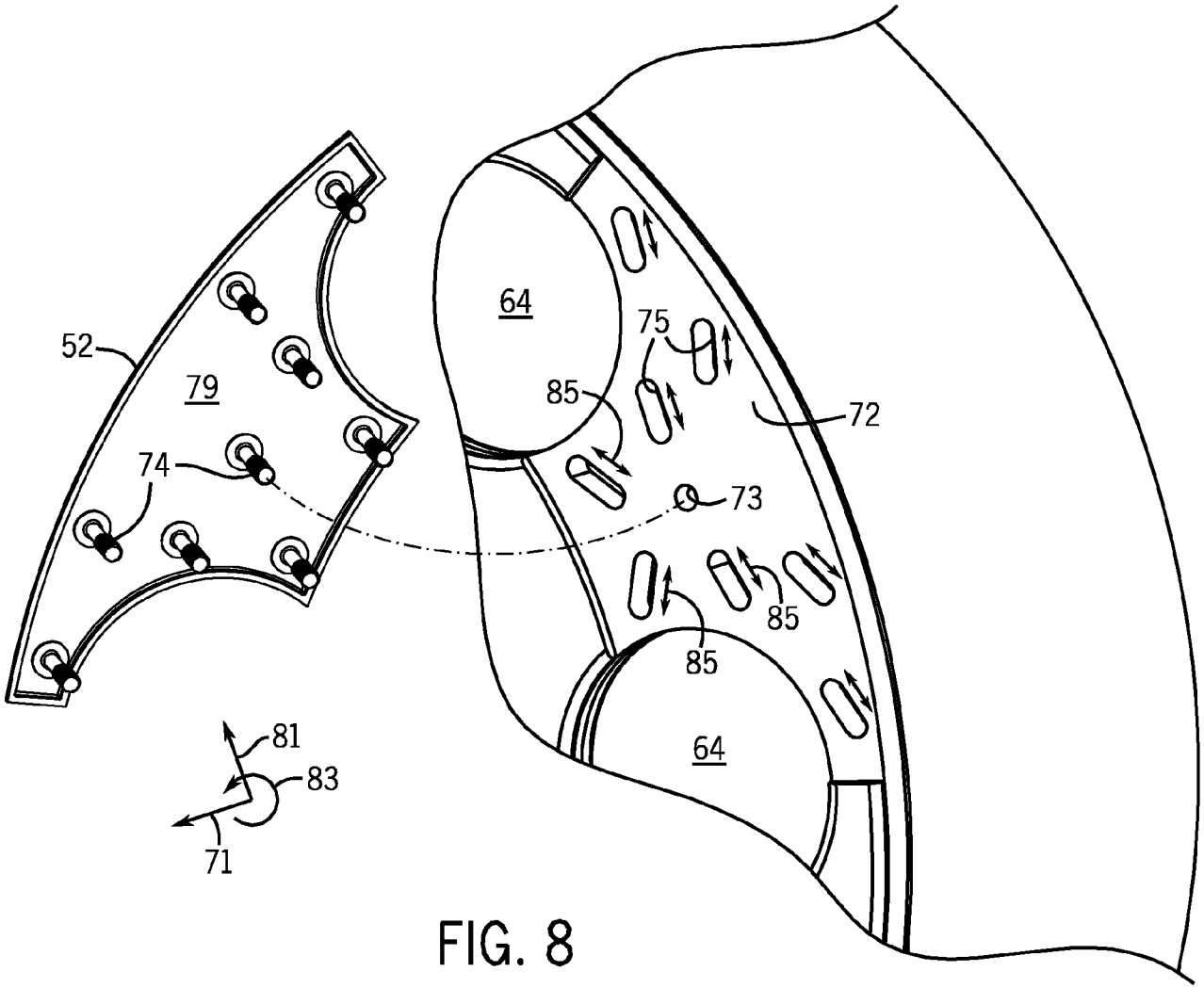
FIG. 8 is a partial front view of the backing plate assembly of FIG. 7, as shown within line 8-8 of FIG. 7, in accordance with an embodiment of the present technique.

As further illustrated in FIGS. 6 and 7, the backing plate 72 may be configured to allow movement of the segments 50, 52, and 54 in the radial 81 and/or circumferential 83 directions. For example, the studs 74 may pass axially 71 through radial 81 and/or circumferential 83 slots in the backing plate 72 to provide axial retention of the segments 50, 52, and 54 relative to the backing plate 72, while permitting some degree of radial and/or circumferential movement of the segments 50, 52, and 54 relative to the backing plate 72. These slots may also be described with reference to FIG. 8, which illustrates a partial top view of the backing plate assembly of FIG. 7, as shown within line 8-8 of FIG. 7.

In one embodiment, the backing plate 72 may include at least one circular stud receptacle 73 and at least one elongated stud receptacle 75. For example, the backing plate 72 may include the circular stud receptacle 73 at a central region of each segment 50, 52, and 54, such that the stud 74 substantially centers the respective segment about at the stud receptacle 73. Thus, the circular stud receptacle 73 may be sized with relatively tight tolerances about the stud 74 to block movement of the segment 50, 52, or 54 at the central stud 74. In contrast, the backing plate 72 may include a plurality of the elongated stud receptacle 75 at peripheral locations away from the central region of each segment 50, 52, and 54, such that each stud 74 can move along the length 85 of its respective elongated stud receptacle 75 to provide relief for thermal expansion. In certain embodiments, the elongated stud receptacles 75 may be oriented only in radial 81 directions. However, some embodiments may include elongated stud receptacles 75 oriented in radial 81 and circumferential 83 directions, or only in circumferential directions. As discussed above, each stud 74 mates with a respective nut 76 to axially secure the segments 50, 52, and 54 to the backing plate 72. In certain embodiments, the nut 76 on the central stud 74 disposed in the circular stud receptacle 73 may be fully tightened to restrict movement of the central stud 74, while the nuts 76 on the peripheral studs 74 disposed in the elongated stud receptacles 75 may be less than fully tightened to facilitate peripheral thermal expansion of each segment 50, 52, or 54. Alternatively, the peripheral studs 74 may include axial spacers (e.g., sleeves) to limit axial compression between the segments 50, 52, and 54 and the backing plate 72. Thus, a central stud 74 may be mounted fixedly to the backing plate 72 to center the segment 50, 52, and 54, and the inner and outer radial studs 74 are mounted to the backing plate 72 with a range of movement to enable thermal expansion relative to the central stud 74. It should also be noted that peripheral studs 74 may be elongated in shape to match the elongated stud receptacles 75 to allow movement of the peripheral studs 74 along the length 85 of each elongated stud receptacle 75.

Figure 9:
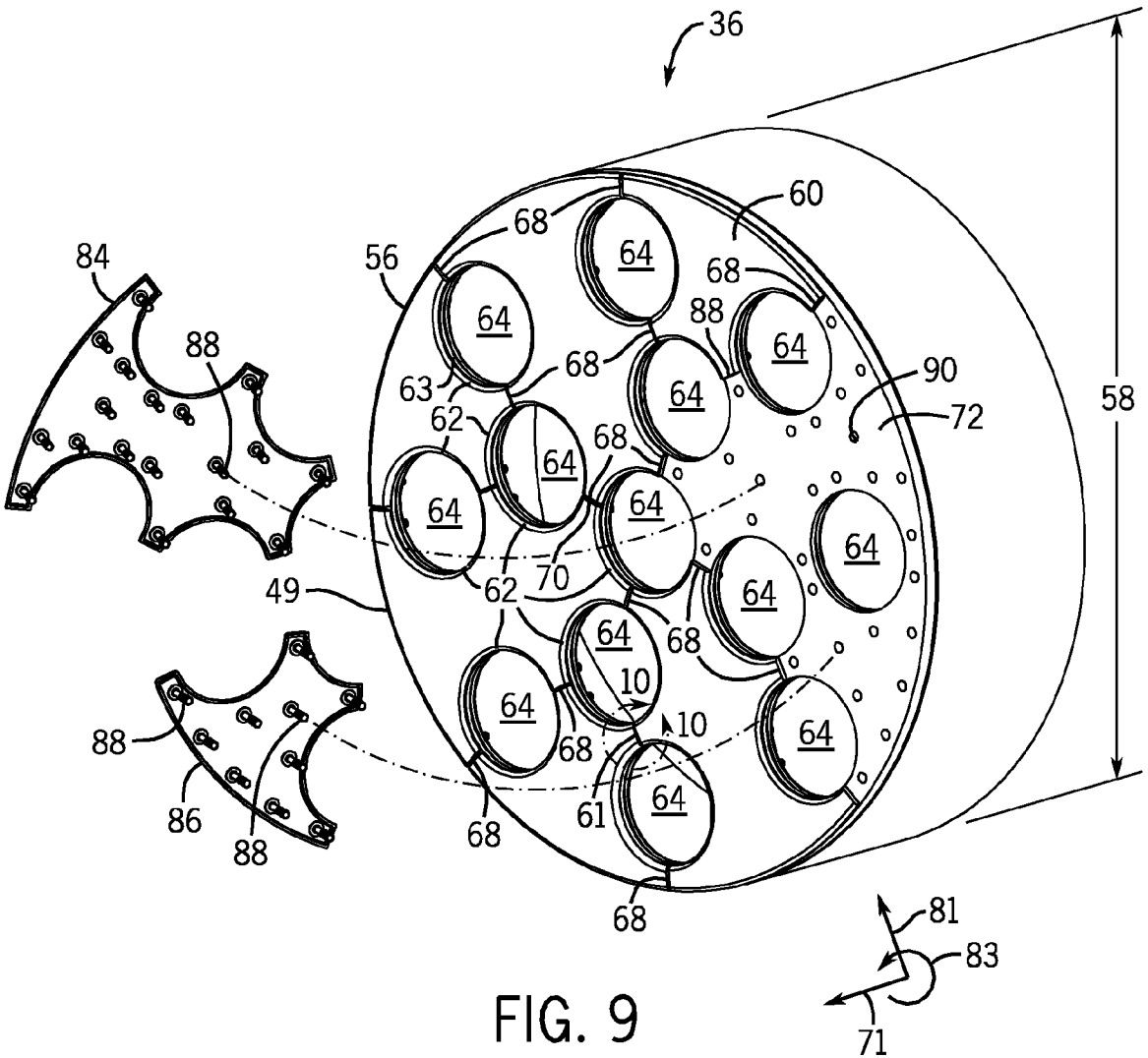
FIG. 9 is a perspective view of a combustor cap assembly with an associated backing plate assembly in accordance with an embodiment of the present technique.

FIG. 9 is an exploded front perspective view of another embodiment the combustor cap assembly 36. Again, the combustor cap assembly 36 includes the outer face 56, the diameter 58, the front face 60, the edges 62, the fuel nozzle receptacles 64, the ligament connections 68, and the air gaps 70 as described above with respect to FIGS. 3, 5, 6, and 7. However, in the illustrated embodiment, the effusion plate 49 has a different set of segments 84 and 86 as compared with the segments 50, 52, and 54 of FIGS. 3, 4, and 5.

Furthermore, segments 84 and 86 may be disposed in a repeatable pattern along an outer circumference of the outer face 56 of the combustor cap assembly 82, whereby the segments 84 and 86 are placed in alternating positions adjacent one another. As illustrated, the segments 84 extend from the outer face 56 to the central region of the combustor cap assembly 36 about a central fuel nozzle receptacle 64. The segments 86 extend from the outer face 56 only partially toward the central region of the combustor cap assembly 36, such that the segments 86 do not reach the central fuel nozzle receptacle 64. In the illustrated embodiment, the effusion plate 49 is defined by four segments 84 and four segments 86 in an alternating symmetrical pattern. In this manner, the segments 84 and 86 combine to cover the entirety of the outer face 56 of the combustor cap assembly 36. Thus, the combustor cap 36 may include a first set of cap segments 86 disposed only along an outer circumference of the combustor cap 36, and a second set of cap segments 84 disposed along both a central region of the turbine combustor cap and along the outer circumference of the turbine combustor cap.

Similar to the segments 50, 52, and 54, the segments 84 and 86 include a plurality of threaded studs or bolts 88 configured to mate with stud receptacles 90 in the backing plate 72. As discussed above, the stud receptacles 90 may include circular stud receptacles 73 and elongated stud receptacles 75, similar to those illustrated in FIG. 8. The circular stud receptacles 73 may be configured to fix the respective segments 84 and 86, while the elongated stud receptacles 75 may be configured to permit radial 81 and/or circumferential 83 movement of the segments 84 and 86. For example, the circular stud receptacles 73 may be oriented at a central location of each segment 84 and 86, such that the retention of the central stud 88 (e.g., via a nut) substantially maintains a centered position of the segment 84 and 86 during thermal expansion or contraction. In contrast, elongated stud receptacles 75 permit movement of the studs 88 along the length of the elongated stud receptacle 75, thereby providing relief for thermal expansion or contraction.

In addition, the combustor cap assembly 36 includes a variety of passages and gaps to facilitate cooling and thermal expansion. For example, the effusion plate 49 of FIG. 5 includes ligament connections 68 and air gaps 70. The air gaps 70 enable both thermal expansion and cooling air flow between adjacent segments 84 and 86 along the ligament connections 68. For example, the segments 84 and 86 may have different coefficients of thermal expansion than the fuel nozzles 12 or other components in the combustor cap assembly 36. Thus, the components may expand or contract at different rates. The air gaps 70 permit some room for this change in geometry, while also enabling cooling air to directly cool the edges 62 of the segments 84 and 86. Examples of the fluid flow into the air gaps 70 to cool the edges 62 of the segments 84 and 86 are illustrated in FIGS. 10 and 11.

Figure 10:
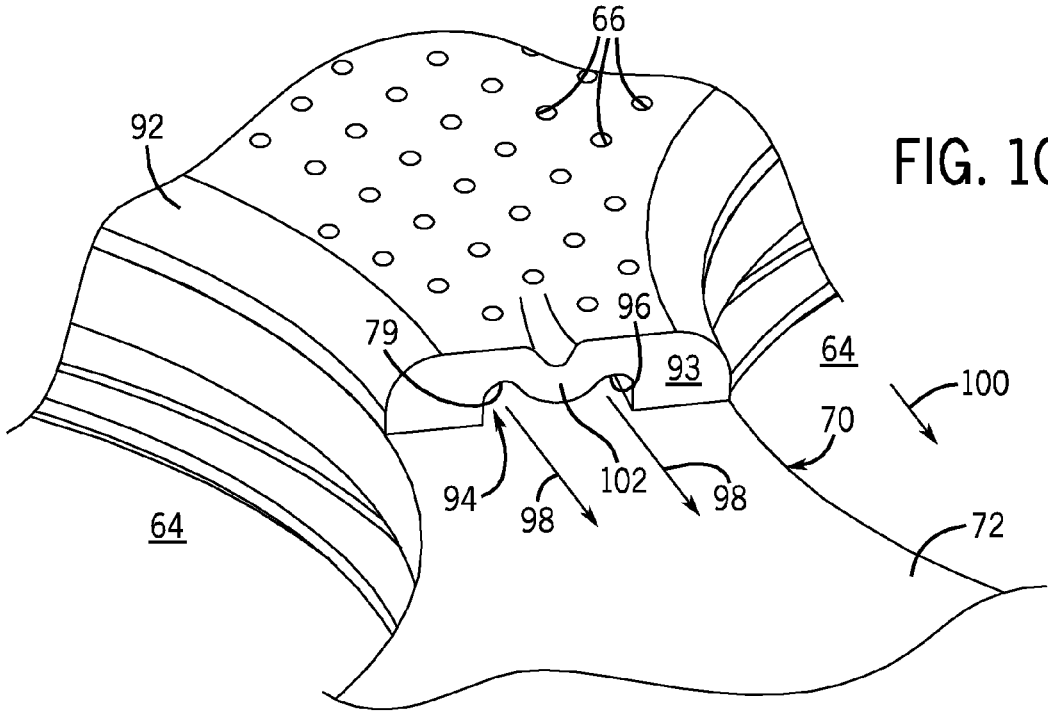
FIG. 10 is a perspective view of a combustor cap assembly as shown within line 10-10 of FIGS. 3 and 9, in accordance with an embodiment of the present technique.

FIG. 10 is a partial perspective view of an embodiment of the combustor cap 36 as shown within arcuate line 10-10 of FIGS. 3 and 9. FIG. 10 illustrates two fuel nozzle receptacles 64, air gap 70, backing plate 72, and a segment 92. As appreciated, the segment 92 may include one of the segments 50, 52, or 54 as illustrated in FIGS. 3, 6, and 7, or one of the segments 84 and 86 as illustrated in FIG. 9. The segment 92 mounts to the backing plate 72 to define a hollow space or intermediate chamber 94 for a coolant flow (e.g., air flow), which may be similar to intermediate cooling chamber 77 of FIG. 5. The intermediate chamber 94 may be, for example, less than about 0.04 to 0.2 inches in width. As discussed above, the coolant flow (e.g., air) may enter the intermediate chamber 94 through passages 80 (e.g., FIG. 5) in the backing plate 72, and directly impinge on a rear surface 79 of the segment 92. In this manner, the air flow provides impingement cooling of the segment 92. In addition, the segment 92 may include the effusion ports 66 to enable effusion cooling of the segment 92. However, the segment 92 may also be utilized without any effusion ports 66, whereby all of the air passes through one or more edge outlets 96, described below.

The segment 92 includes one or more edge outlets 96, (e.g. cooling jet outlet), that may transmit one or more cooling jets 98 in a direction indicated by arrow 100. Each outlet 96 may include an opening of at least approximately 10, 20, 30, 40, 50, 60, 70, 80, 90, or 100 percent of the area of the outlet face 93 of the segment 92. Furthermore, the outlet 96 may include a divider 102 that may divide the cooling jets 98. The divider 102 may be utilized to direct the flow of the cooling jets 98 into the air gap 70 for cooling along the air gap 70 between adjacent segments 92. In certain embodiments, the divider 102 may split and channel the air flow in a diverging manner outwardly toward the opposite fuel nozzle receptacles 64.

Figure 11:
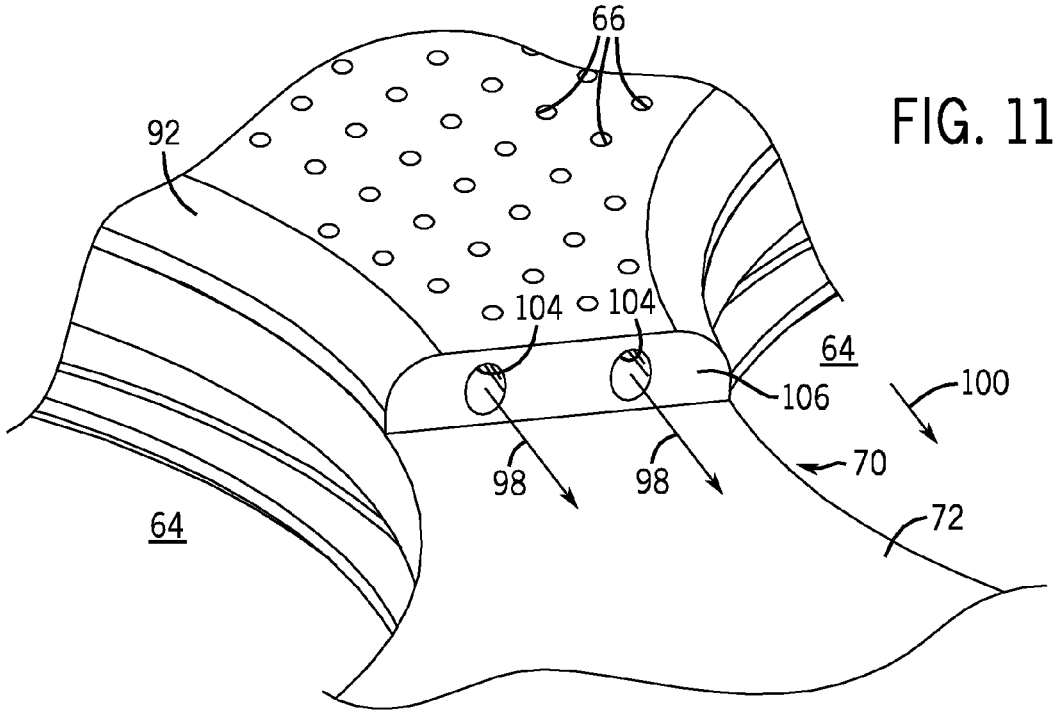
FIG. 11 is a perspective view of a combustor cap assembly as shown within line 10-10 of FIGS. 3 and 9, in accordance with an embodiment of the present technique.

FIG. 11 is a partial perspective view of an embodiment of the combustor cap 36 as shown within arcuate line 10-10 of FIGS. 3 and 9. Similar to the embodiment of FIG. 10, the illustrated embodiment of FIG. 11 includes two fuel nozzle receptacles 64, air gap 70, backing plate 72, and segment 92. As appreciated, the segment 92 may include one of the segments 50, 52, or 54 as illustrated in FIGS. 3, 6, and 7, or one of the segments 84 and 86 as illustrated in FIG. 9. The segment 92 mounts to the backing plate 72 to define the intermediate chamber 94 (FIG. 10), which receives impinging coolant flow (e.g., air flow) from passages 80 (e.g., FIG. 5) and exhausts the coolant flow through effusion ports 66. Furthermore, the segment 92 may also be utilized without any effusion ports 66, whereby all of the air passes through one or more edge outlets 104, described below.

In addition, the segment 92 of FIG. 11 includes one or more edge outlets 104, (e.g. cooling jet outlet), that may transmit one or more cooling jets 98 in a direction indicated by arrow 100. The outlets 104, which may be openings in a faceplate 106, may be sized to at least approximately 5, 10, 20, 30, 40, 50, 60, 70, or 80 percent of the height of the faceplate 106. The faceplate 106 may be utilized to direct the flow of the cooling jets 98 into the air gap 70 for cooling along the air gap 70 between adjacent segments 92. In this manner, the outlets 104 substantially perform in a similar manner to the outlet 96 described above with respect to FIG. 10. Indeed, the outlets 104 may be utilized either in conjunction with, or in place of outlets 96, as suitable for cooling between adjacent segments 92.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine engine, comprising:

a combustor having a head end;

a backing plate disposed in the head end; and a combustor cap coupled to the backing plate, wherein the backing plate and the combustor cap comprise a fuel nozzle receptacle, the combustor cap comprises a plurality of segments disposed about the fuel nozzle receptacle; and an air gap between adjacent segments in the plurality of segments, wherein each segment comprises an edge outlet configured to direct air into the air gap towards an adjacent segment.

2. The system of claim 1, wherein the plurality of segments comprises a first set of cap segments disposed along an outer circumference of the combustor cap, and a second set of cap segments disposed at a central region of the combustor cap.

3. The system of claim 1, wherein each segment comprises a hollow interior facing the backing plate.

4. The system of claim 1, wherein each segment comprises a plurality of studs coupled to the backing plate.

5. The system of claim 4, wherein the plurality of studs on each segment comprises a central stud, an inner radial stud, and an outer radial stud, wherein the central stud is mounted fixedly to the backing plate to center the segment, and the inner and outer radial studs are mounted to the backing plate with a range of movement to enable thermal expansion relative to the central stud.

6. The system of claim 1, wherein the edge outlet comprises two distinct ports.

7. The system of claim 1, comprising an intermediate cooling chamber between the backing plate and the plurality of segments, wherein the backing plate comprises an impingement passage directed toward an interior face of each segment of the plurality of segments.

8. The system of claim 1, wherein each segment comprise at least about 100 air effusion ports, and each effusion port is at least less than about 80 thousands of an inch in diameter.

9. A system, comprising:

a turbine combustor cap comprising a plurality of segments, wherein each segment of the plurality of segments has edges abutting at least two fuel nozzle receptacles without completely surrounding any one fuel nozzle receptacle;

a ligament connection disposed in an air gap between any two segments of the plurality of segments, wherein the ligament connection is configured to allow for thermal expansion of each of the two segments without contacting one another; and at least one cooling jet outlet configured to cool at least one of the plurality of segments by directing air into the air gap.

10. The system of claim 9, wherein the plurality of segments comprises a first set of cap segments disposed only along an outer circumference of the turbine combustor cap, and a second set of cap segments disposed along both a central region of the turbine combustor cap and along the outer circumference of the turbine combustor cap.

11. The system of claim 9, wherein the plurality of segments comprises a first set of cap segments disposed along an outer circumference of the turbine combustor cap, and a second set of cap segments disposed around a central region of the turbine combustor cap, wherein the first set of cap segments completely encloses the second set of cap segments.

12. The system of claim 9, comprising a plurality of effusion ports positioned along a surface of each of the plurality of segments and configured to pass air from the effusion ports for cooling of the segments.

13. The system of claim 12, wherein the effusion ports are oriented at an angle relative to a front face of each of the plurality of segments, and the angle is between approximately 20 to 90 degrees relative to the front face of each of the plurality of segments.

14. A system, comprising:

a turbine combustor cap comprising a plurality of segments each comprising a front face, a rear face, and edges perpendicular to the front face and the rear face, wherein at least one of the edges of each segment comprises an edge air port adjacent an air gap between adjacent segments in the plurality of segments and configured to provide air into the air gap in a direction parallel to the front face and the rear face, and each segment comprises a plurality of air effusion ports extending from the rear face, through the segment, and out of the front face.

15. The system of claim 14, wherein each air effusion port is positioned at an angle of between approximately 20 to 90 degrees relative to the front face.

16. The system of claim 14, wherein the air gap is sized to allow for thermal expansion of each of the adjacent segments without contacting one another.

17. The system of claim 16, wherein each segment comprises a divider configured to direct the air of the edge air port.

18. The system of claim 14, wherein each segment comprises a plurality of studs coupled to a backing plate, wherein the plurality of studs on each segment comprises a central stud, an inner radial stud, and an outer radial stud, wherein the central stud is mounted fixedly to the backing plate to center the segment, and the inner and outer radial studs are mounted to the backing plate with a range of movement to enable thermal expansion relative to the central stud.

* * * * *